US005611222A

United States Patent [19]

Preece et al.

[11] Patent Number: 5,611,222

[45] Date of Patent: Mar. 18, 1997

[54] REDUCING WORKPIECE THICKNESS

[75] Inventors: Clive Preece, Durham; John E. L. Simmons, Edinburgh; David C. Reedman, Wartnaby; Sterghios Topis, Tyne and Wear, all of United Kingdom

[73] Assignee: British United Shoe Machinery Ltd., England

[21] Appl. No.: 433,439

[22] PCT Filed: Nov. 17, 1993

[86] PCT No.: PCT/GB93/02364

§ 371 Date: Jun. 21, 1995

§ 102(e) Date: Jun. 21, 1995

[87] PCT Pub. No.: WO94/12671

PCT Pub. Date: Jun. 9, 1994

[30] Foreign Application Priority Data

Nov. 20, 1992 [GB] United Kingdom ..... 9224347

[51] Int. Cl.[6] ..... C14B 1/02

[52] U.S. Cl. ..... 69/9; 69/21.5; 83/874

[58] Field of Search ..... 69/9, 9.5, 10, 16, 69/15, 11, 12, 13, 47, 21, 21.5; 83/870, 871, 872, 873, 874

[56] References Cited

U.S. PATENT DOCUMENTS

| | | | |
|---|---|---|---|
| 1,038,560 | 9/1912 | Gay | 83/874 |
| 1,383,133 | 6/1921 | Lucke | 83/874 |
| 3,165,912 | 1/1965 | Grossmann | 69/10 |
| 3,186,195 | 6/1965 | Braun | 69/10 |
| 3,298,414 | 1/1967 | Runnells, Jr. | 69/9 |
| 3,340,916 | 9/1967 | Burch | 83/870 |
| 3,393,538 | 7/1968 | Mercier | 83/874 |
| 3,538,723 | 11/1970 | Imgrund et al. | 69/10 |
| 3,631,693 | 1/1972 | Morletto | 69/10 |
| 3,736,776 | 6/1973 | Repetto | 69/13 |
| 3,780,605 | 12/1973 | Fingerie et al. | 83/874 |

FOREIGN PATENT DOCUMENTS

| | | | |
|---|---|---|---|
| 495354 | 7/1992 | European Pat. Off. | 69/13 |

*Primary Examiner*—Michael A. Neas

[57] ABSTRACT

A method of and apparatus for reducing the thickness of (or skiving) regions of sheet material workpieces, e.g. shoe upper components, involves feeding a workpiece 14 to a band knife (4) and, in advance of said knife, applying pressure to the workpiece 14, using a row of pressure-applying elements (18) to deform a region of the workpiece in relation to the cutting plane (20) of the knife. By controlling the elements (18) to operate in successive sequences of combinations, regions of the workpiece (14) are successively skived as the workpiece (14) passes the knife (4). The operation of the elements (18) is controlled by a computer (CPU), having a memory in which workpiece information data, relating to certain workpiece parameters, as well as in accordance with shape, positional and orientational data is stored. Such data may be generated using optical recognition workpiece means (100,120,140,160).

9 Claims, 8 Drawing Sheets

REDUCING WORKPIECE THICKNESS

BACKGROUND OF THE INVENTION

This invention relates to the treatment of sheet material workpieces to reduce the thickness of selected regions thereof. One instance of such treatment is to be found in the manufacture of shoes wherein certain regions, particularly the edges, of shoe upper components are reduced in thickness (or "skived") prior to assembling the shoe upper. Skiving is effective to reduce bulkiness in the upper and to aid its assembly, and thus to improve the appearance of the finished upper and to avoid discomfort of the wearer.

One known method of skiving is described in GB-A-1178960. The method involves supporting a workpiece between an upper and a lower feed roller whilst it is fed to a band knife. Sandwiched between the workpiece and the upper roller is a matrix (hence the method is referred to as "matrix skiving") which carries a relief pattern having raised regions corresponding to the workpiece regions that are subsequently to be reduced by the band knife. The regions of the workpiece engaged by the raised relief pattern are forced downwards against a compressible surface on the lower roller, and consequently below the cutting plane of the band knife. Any portion of the workpiece disposed below the cutting plane is removed by the knife as it is fed therepast, and thus a workpiece is produced with a pattern of reduced thickness regions that match the raised relief pattern of the matrix.

There are, however, problems associated with this existing method of matrix skiving namely that each workpiece and each pattern requires a unique matrix, and the matrix has manually to be registered with the workpiece prior to sandwiching the workpiece and matrix between the feed rollers, which involves time and effort on the part of the operator that can affect output potential. In addition, there is some difficulty involved in achieving successful registration of the workpiece and matrix, and this difficulty enhances the possibility of producing inaccurately skived workpieces.

U.S. Pat. No. 3,538,723 describes an apparatus and method of splitting sheet material workpieces, that is, tanned hides. A support roller has heightwise adjustable sections that enable differing degrees of support pressure to be applied across the width of the hide. The potential variation in support pressure provides the possibility of compensating for the inherent non-uniformity in the thickness of the hide and consequently prevents excessive compression, which could result in the production of a non-uniformly split hide. However, as the process relates to splitting rather than skiving, the hide is supported in a position such that the cutting plane of the knife to which the hide is fed lies at all times within the material of the hide.

OBJECT OF THE INVENTION

It is an object of the invention to provide a method of and apparatus for reducing the thickness of selected regions of workpieces, whereby to maximise output potential by reducing the operator's workpiece preparation time and to minimise the occurrence of inaccurately skived workpieces, such method and apparatus being adaptable to produce any desired pattern of reduced thickness regions for any particular workpiece.

SUMMARY OF THE INVENTION

The present invention thus provides, in one of its several aspects, a method of treating a sheet material workpiece to reduce the thickness of a selected region thereof using a band knife, in carrying out which method the workpiece is supported on a support for advancing movement past a blade portion of the band knife, which blade portion extends, in a cutting plane, transversely of the workpiece feed direction, the workpiece being deformed in relation to the cutting plane in at least one region thereof, as it is advanced past the knife, such that a portion of the material in said region is removed by the knife thereby reducing the thickness of the workpiece at said region, wherein the deformation of the workpiece is effected by a plurality of pressure-applying elements extending in at least one row, immediately in advance of the knife, transversely of the workpiece feed direction, each element being independently movable between an extended condition, in which it applies pressure to a section of the workpiece region to cause said section to be deformed, and a retracted condition, in which it does not apply such pressure, selected combinations of the elements being successively located in their extended condition in timed relation with the progressive advancing of the workpiece according to the desired shape of the selected region whose thickness is to be reduced, characterised in that when pressure is applied as aforesaid to a selected region of the workpiece by the elements the support for the workpiece yields, thereby allowing the relationship between said region and the cutting plane, and thus the cutting blade, to be varied.

The invention further provides, in another of its several aspects, an apparatus for the treatment of a sheet material workpiece to reduce the thickness of a selected region thereof, comprising a band knife having a blade portion extending in a cutting plane, workpiece feeding means for supporting a workpiece to be treated and feeding it past the band knife, the blade portion of which extends transversely of the workpiece feed direction, a plurality of pressure-applying elements extending in at least one row, immediately in advance of the knife,transversely of the workpiece feed direction, each element being independently movable between an extended condition, in which it can apply pressure to a section of a workpiece region to cause said section to be deformed in relation to the cutting plane, and a retracted position, in which it does not apply such pressure, actuator means for effecting movement of each pressure-applying element into and out of its extended condition, and control means for controlling the operation of the actuator means whereby combinations of elements can be caused to be successively located in their extended condition in timed relation with the operation of the workpiece feeding means, characterised in that the workpiece feeding means comprises a workpiece support which is capable of yielding under pressure applied by the elements, thereby allowing the relationship between said workpiece region supported thereby and the cutting plane, and thus the cutting blade portion, to be varied.

In carrying out the method in accordance with the invention, furthermore, preferably "upstream" of the pressure-applying elements the workpiece is supported with both upper and lower surfaces thereof disposed at one side of the cutting plane, deformation of the region of the workpiece causing the material at said region to be deformed across the cutting plane, whereby at least a portion thereof is removed as it moves past the band knife.

It will thus be appreciated that using the apparatus in accordance with the invention, in carrying out a method in accordance with the invention, workpieces can be skived without the need for a dedicated matrix, but rather the pressure-applying elements can be controlled automatically to produce any of a range of skive patterns for any of a range of workpieces; the control of the elements is dynamic to the extent that different sequences of combinations of elements can be located in their extended condition according to the particular workpiece and according to the skive pattern to be produced. Rendering the control of the elements automatic means that an operator need only then concern himself/herself with placing workpieces to be skived on the workpiece feeding means. Moreover, by arranging the workpiece in its "undeformed" condition with both surfaces thereof disposed at one side of the cutting plane, only the selected regions, which undergo deformation, are skived in the operation of the apparatus.

Preferably in carrying out the method in accordance with the invention the movement of the pressure-applying elements is controlled by computer control means in accordance with a programmed instruction containing pattern data relating to the desired shape of the selected region. More particularly, the programmed instruction conveniently contains pattern data relating to the succession of combinations of pressure-applying elements to be located in their extended condition.

In one embodiment of the invention, furthermore, the workpiece shape is identified by optical workpiece recognition means, which also identifies the position and orientation of the workpiece, and the data contained in the programmed instruction relates to the pattern of the selected region, said data being modified according to the position and orientation of the workpiece as identified by the workpiece recognition means, and the movement of the pressure-applying elements being controlled in accordance with such modified data.

More particularly, in said embodiment the optical workpiece recognition means is operative to scan a workpiece to be treated and to generate signals and supply them to the computer control means according to certain parameters of the workpiece. In such a case, moreover, the computer control means preferably comprises processor means for processing such signals to provide workpiece data relating to said certain parameters of the workpiece and also workpiece positional and orientational data, and a memory for storing comparison data relating to previously scanned workpieces, pattern data relating to selected regions of such workpieces the thickness of which regions is to be reduced, and assignment data associating comparison data for a particular workpiece with pattern data for a particular selected region, the arrangement being such that when a workpiece has been scanned by the workpiece recognition means the processor means compares the workpiece data with the comparison data and, upon finding a match, selects the associated pattern data, and then modifies the pattern data in accordance with the workpiece positional and orientational data, and the processor means supplies control signals to the actuator means in accordance with the thus modified data.

By using computer control means in this manner, it will be appreciated, the control of the pressure-applying elements can be rapidly implemented, in timed relation with the operation of the workpiece feed means, in order to bring the selected region accurately and reliably to the blade portion of the band knife. Moreover, by the use of the optical workpiece recognition means the operator may load the workpiece on to the workpiece feed means in any random position and/or orientation and the workpiece will be "recognised" as to its identity as well as its position and orientation and the pattern data will then be modified accordingly and the whole skiving operation be implemented without any interference from the operator.

The actuator means may comprise a plurality of actuators, one associated with each pressure-applying element, each such actuator having its own drive arrangement; for example, each actuator may be piezoelectrically driven. Piezoelectric actuators have the advantage of being relatively small so that they can be accommodated in the relatively narrow spaces available if the pressure-applying elements are to be sufficiently closely arranged with one another to provide adequate resolution of the skived pattern.

Alternatively, the actuator means may comprise a single actuator device which operates through an appropriate linkage or the like, such linkage or the like being selectively engageable with the pressure-applying elements again under the control of the computer control means.

Where individual actuators are provided, conveniently the deformation of the workpiece section engaged by a given pressure-applying element, and thus the amount of material removed at said section by the knife, is determined according to the amount of the pressure applied by the actuator; that is to say, by varying the pressure applied by the actuator (which in the case of a piezoelectric actuator is a function of the power supplied to it) the amount of deformation can be thus controlled.

In one embodiment of the invention the workpiece feeding means comprises a reach of a conveyor band an upper, workpiece-supporting, surface of which lies in the cutting plane, but which is capable of yielding under pressure applied by the pressure-applying elements and thus being urged out of said plane. In such an arrangement, furthermore, a further belt may be provided which is advanced synchronously with the conveyer band and between which and the conveyer band a workpiece can be held and thus be fed progressively towards the knife, the pressure-applying elements applying pressure to sections of the workpiece through said belt. By the provision of such a further belt, any tendency of the pressure-applying elements to drag the workpiece out of position on the workpiece feeding means can be avoided. Moreover, preferably the surfaces of the belt and the workpiece feeding means contacting the workpiece have a relatively high coefficient of friction while the surface of the belt contacted by the elements has a relatively low coefficient of friction. In this way the accuracy of the feeding of the workpiece can be enhanced.

There now follows a detailed description, to be read with reference to the accompanying drawings, of three apparatuses, together with their methods of use, in accordance with the invention. It will be understood that these apparatuses and their methods of use have been selected for description merely by way of non-limiting example of the invention.

DESCRIPTION OF THE PREFERRED EMBODIMENTS

Figure 1:
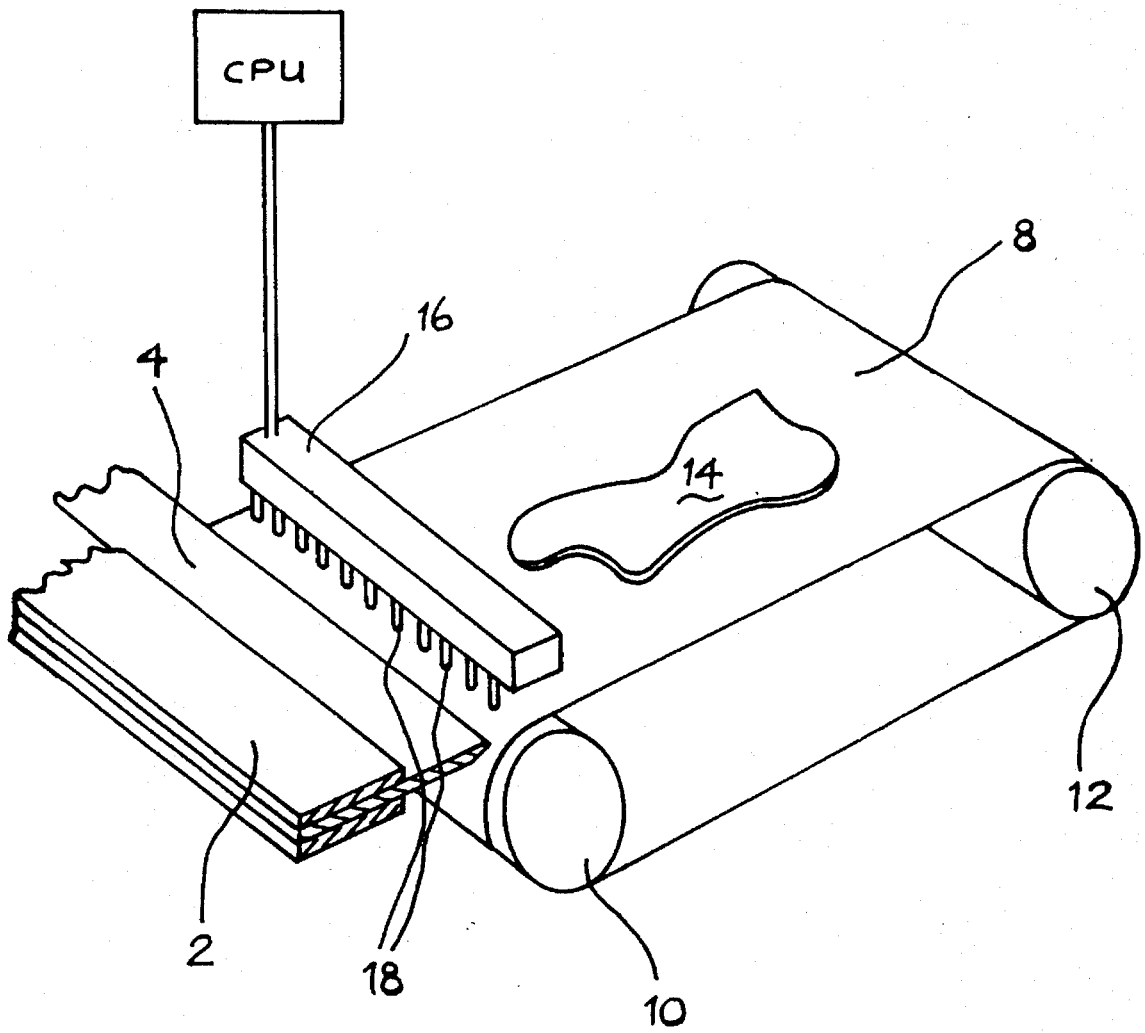
FIG. 1 is a perspective view of a first apparatus in accordance with the invention.
Figure 2:
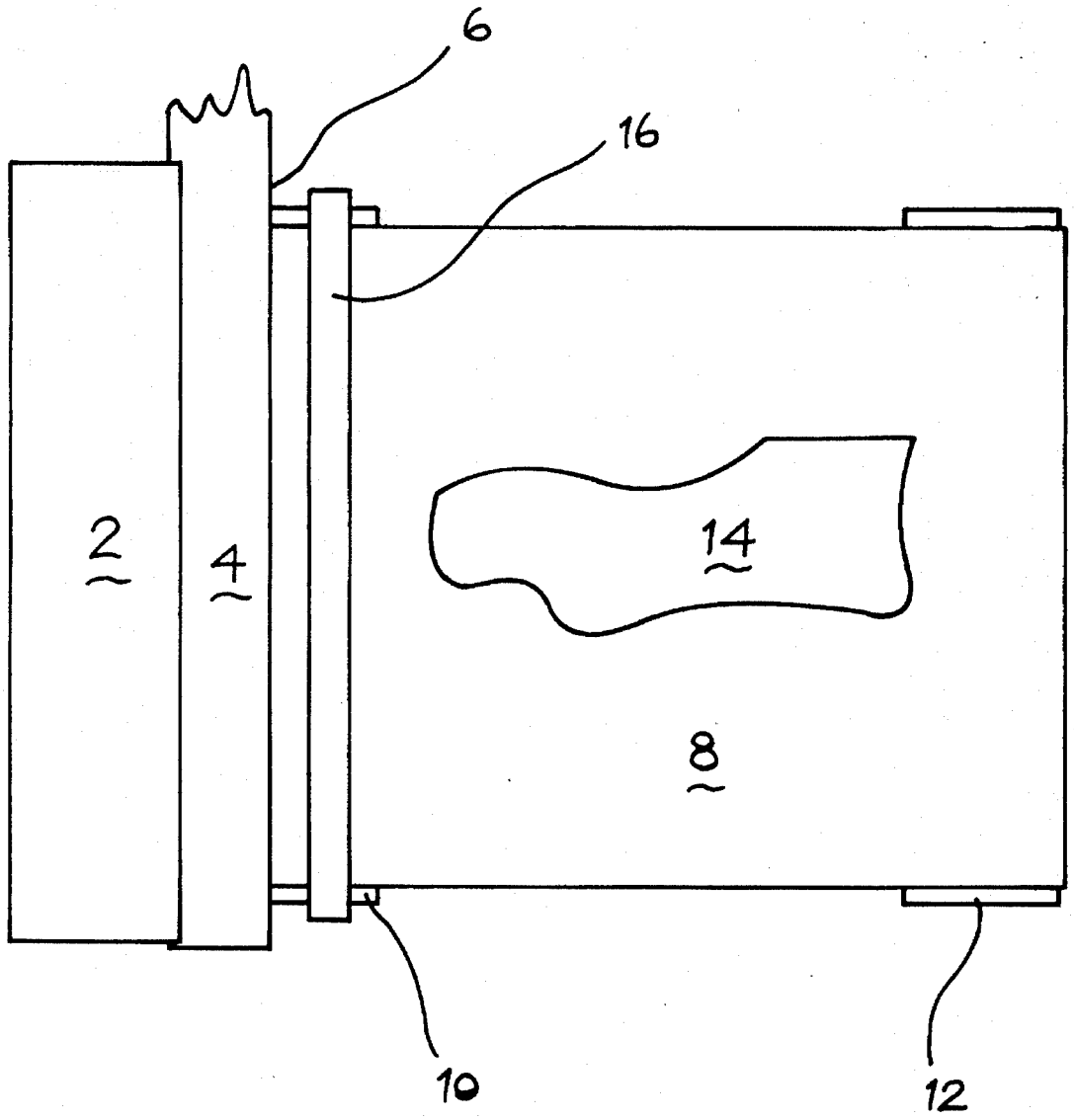
FIG. 2 is a plan view of the apparatus shown in FIG. 1.
Figure 3:
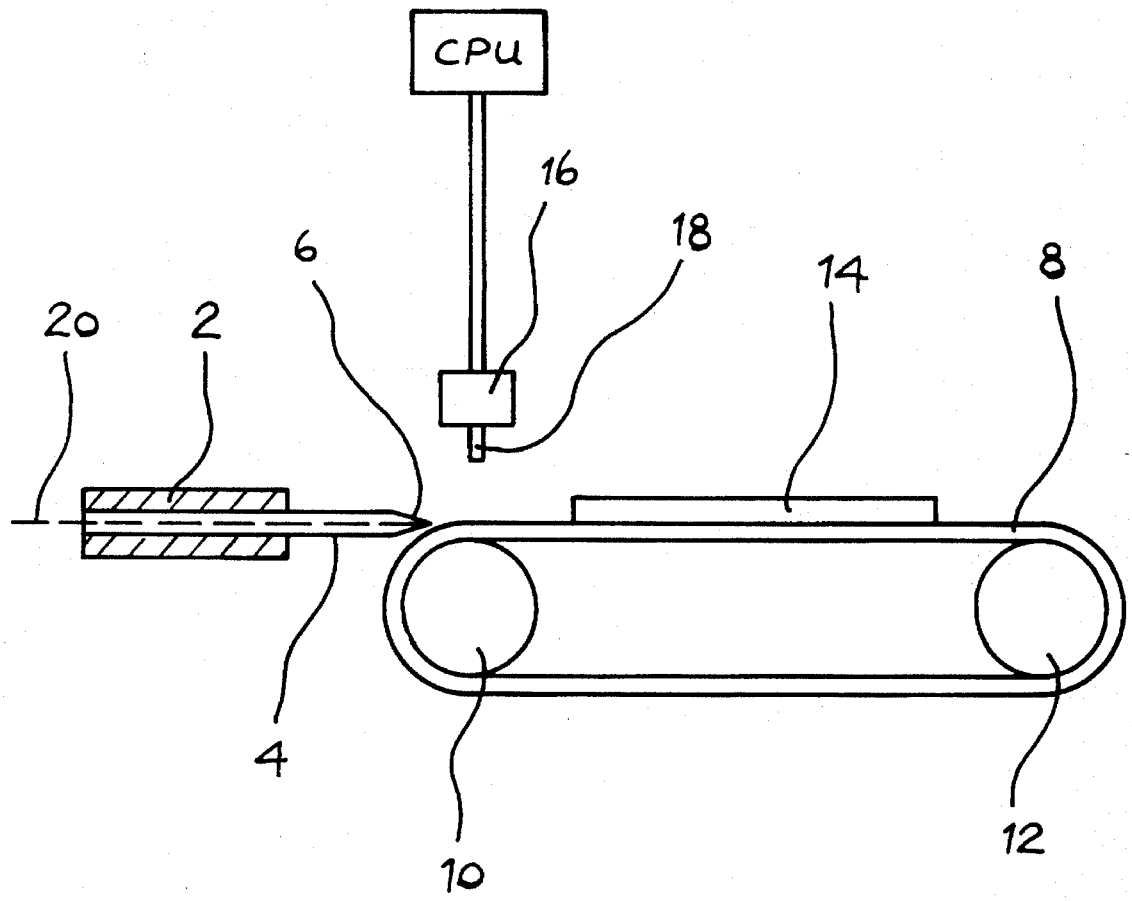
FIG. 3 is a side view of the apparatus shown in FIG. 1.

Shown in FIGS. 1, 2 and 3, in schematic form, is a first apparatus in accordance with the invention having a band knife 4 supported by a knife holder 2 adjacent one end of an upper reach of a continuous conveyer band 8 which runs around a conveyer drive roller 10 and an idler roller 12. A workpiece 14, typically a footwear component, is supported by the upper reach of the conveyer band 8. The conveyer band 8 is driven by a motor (not shown) through the drive roller 10 so as to feed the supported workpiece 14 towards the knife 4, i.e. right to left as viewed in FIGS. 1 to 3. The knife 4 is supported with a blade portion 6 thereof positioned just outwardly of the location at which the conveyer band 8 begins to conform to the curvature of the drive roller 10. The heightwise position of the knife 4 can be adjusted in order that a cutting plane 20 passing through the blade 6 lies coincident with, or just below, the plane of an upper surface of the upper reach of the conveyer band 8, such that the workpiece 14, when supported by said surface is supported with its lower surface (and therefore both its lower and upper surfaces) disposed above the cutting plane (20).

Arranged above the conveyer band 8 (by an arrangement not shown) just in advance (in terms of workpiece feed direction) of the blade 6, is a plurality of pressure-applying elements, in the form of pins 18, arranged in a row and protruding downwards towards the conveyer band 8. (It is to be understood that in other apparatus in accordance with the invention the pins may be arranged in a plurality of rows extending transversely of the workpiece feed direction.) The row extends over approx. 30 mm long, with the pins 18 spaced 2 mm apart, and is aligned, transversely of, more particularly perpendicularly to, the workpiece feed direction. Each pin 18 is independently movable between an extended condition, in which it is extended towards the cutting plane of the blade 6, and a retracted condition (shown in FIGS. 1 to 3), in which it is retracted away from a plane level with the upper surface of the supported workpiece 14. To this end, each pin 18 has an individual actuator 16 (not shown individually, but rather as a unit accommodated together in a housing therefor). The actuators are piezoelectrically driven; a piezoelectric effect is utilised to operate a mechanical lever (not shown) that acts upon the pin. Also associated with each pin 18 is a brake (not shown) which holds the actuator in the position to which it is driven by the actuator. The brake is released during movement of the pin between its extended and retracted conditions.

In using the first apparatus in carrying out a first method in accordance with the invention, when any one of the pins 18 is located in its extended condition, a section of a workpiece 14 engaged thereby is deformed into a condition in which the upper and lower surfaces thereof become disposed one at each side of the cutting plane 20, that is to say the cutting plane 20 passes through the body of the material at said section, with a result that as the section is moved past the blade 6 a portion is skived therefrom. To this end, as can be seen from the FIG. 4, the conveyer band 8 is compressible and indeed compresses under the application of pressure by one or more pins 18.

Figure 4:
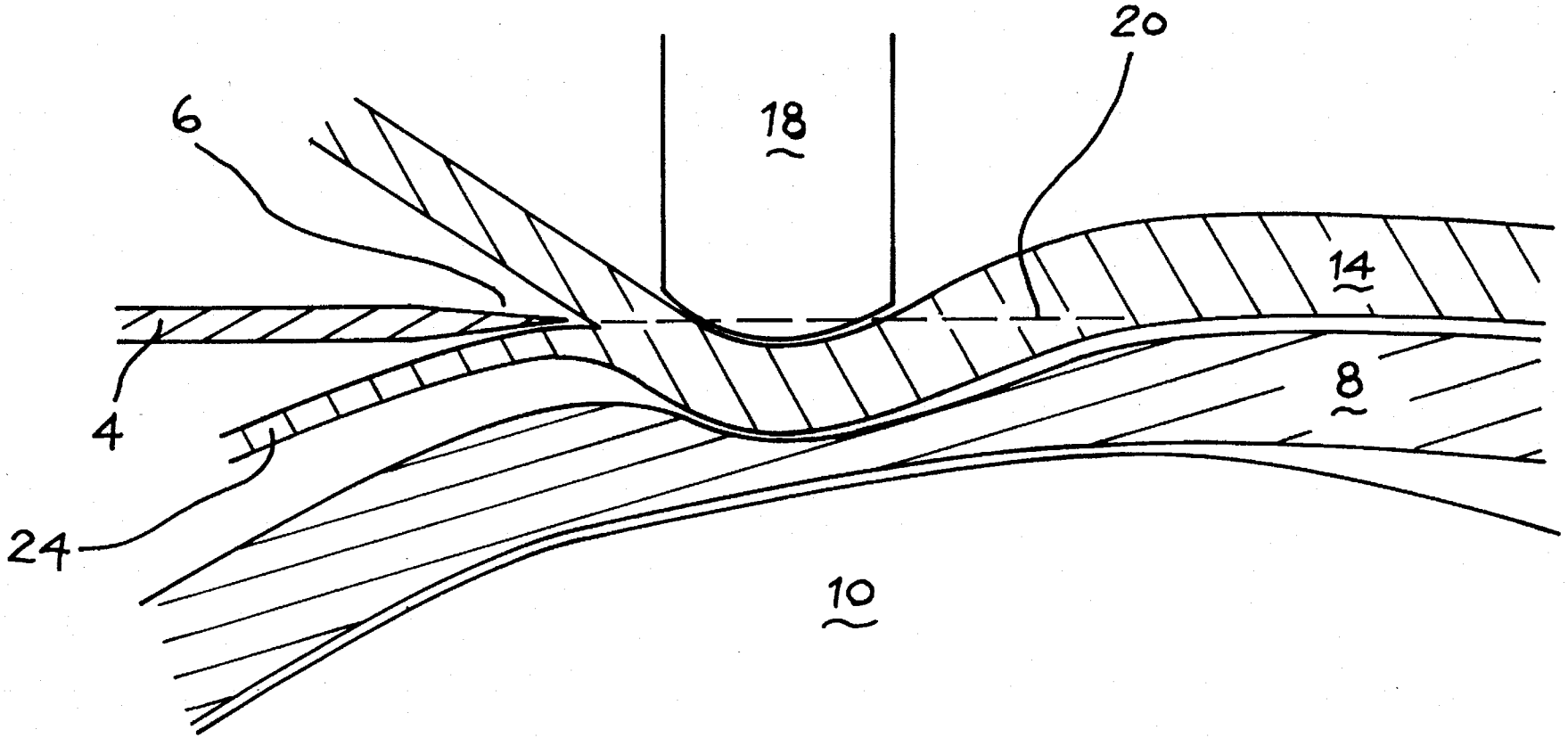
FIG. 4 is a fragmentary view, on an enlarged scale, illustrating the action of one of the pressure-applying elements of the apparatus shown in FIG. 1.

FIG. 4 shows how, as the workpiece 14 passes underneath one of the pins 18 in its extended condition, pressure is applied locally to the section of the workpiece 14 thus engaged, whereby the workpiece is deformed in relation to the cutting plane 20 at said section. It will be appreciated that if the workpiece 14 is considered to be divided widthwise into a series of sections, each pin 18 is only capable of applying pressure locally to one of the sections at any one time. The number of sections into which the workpiece can be considered to be divided is obviously dependent upon the number and spacing of the pins. Consequently, increased accuracy of skiving can be achieved by increasing the number of and reducing the spacing between the pins, so as to heighten the resolving power of the apparatus.

FIG. 4 also illustrates that by reason of the proximity of the pins 18 to the blade 6 the application of pressure to a workpiece section in advance of the blade 6 results in a layer 24 being skived from the lower surface of the workpiece "downstream" of the pin 38 (in the workpiece feed direction). In comparison, those sections of the workpiece 14 which pass underneath a pin 18 which is in its retracted condition remain undeformed, with both upper and lower surfaces thereof above the cutting plane 20, so that no layer is skived from those workpiece sections.

A region, made up of a plurality of adjacent sections, can be skived from the workpiece 14 by bringing those pins 18 which correspond to the sections in combination into their extended condition at the appropriate time as the region passes underneath the row of pins 18. The combination of pins must of course be located in their extended condition in timed relation with the feeding of the workpiece 14 to ensure that the selected region thereof is skived. Moreover, it will be appreciated, as the shape of the region transversely of the feed direction changes, different combinations of pins 18 will be correspondingly selected. Where a pin is included in two different combinations it may remain in contact with the workpiece; alternatively each combination may be retracted as a unit and the new combination then be brought into its extended condition.

Figure 5:
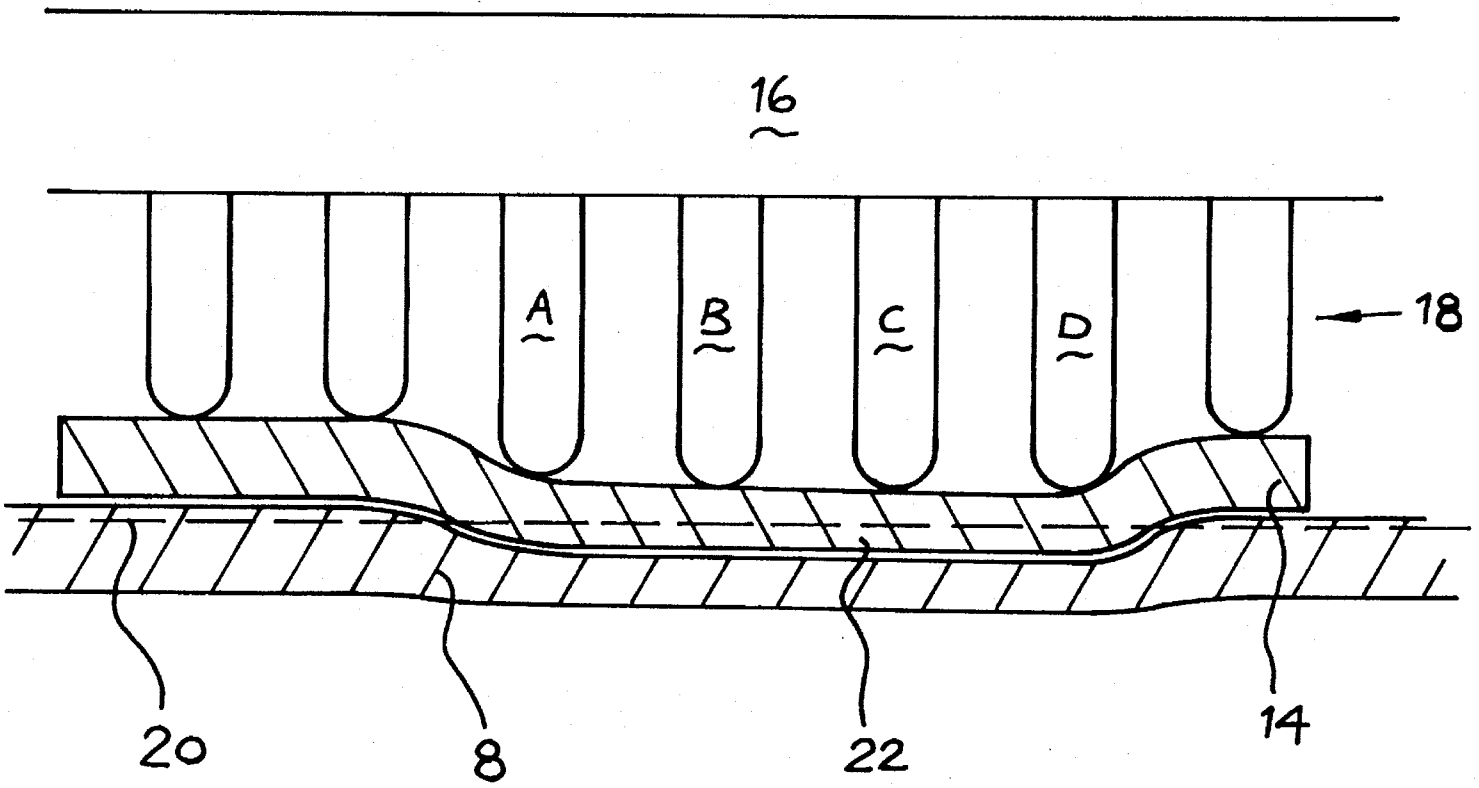
FIG. 5 is a fragmentary view, taken at right angles to that of FIG. 4, illustrating the action of a plurality of pressure-applying elements of the apparatus shown in FIG. 1.

FIG. 5 shows a combination (A to D) of pins 18 in their extended condition at a particular juncture in the feeding of the workpiece 14 under the pins 18, thereby deforming a selected, in this case central, region 22 of the workpiece 14 into a condition in which the upper and lower surfaces of the workpiece in the region 22 are disposed one at each side of the cutting plane 20. The result of this deformation is that the thickness of the region 22 is reduced by the cutting action of the knife.

The depth by which the workpiece 14 is reduced in thickness at the region 22 is dependent upon the amount of pressure applied by the pins 18. Consequently, the degree of reduction in thickness can be controlled, through the control of the actuators 16, by varying the pressure, and hence by varying the amount of the deformation of the workpiece region or sections thereof. It follows that the pins do not assume a pre-set height in relation to the conveyer band 8 when in their extended condition.

Figure 6:
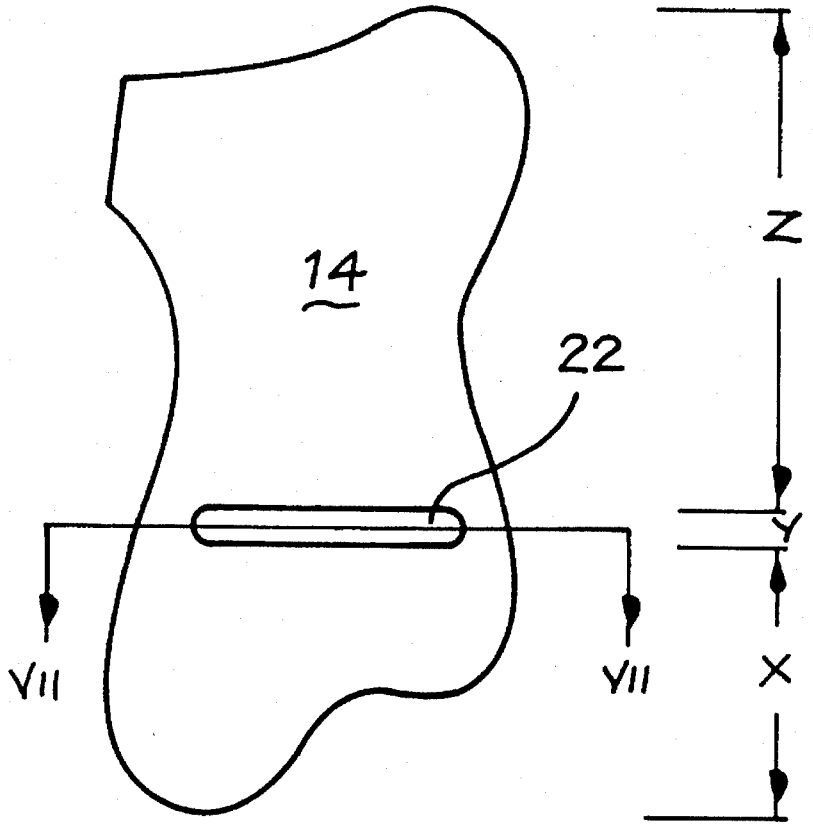
FIG. 6 is an underneath plan view of a workpiece which has been skived using the apparatus shown in FIG. 1.
Figure 7:
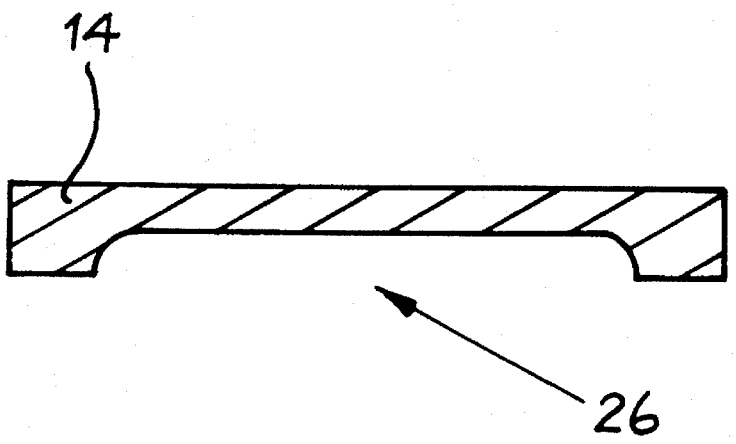
FIG. 7 is a cross-sectional view of the workpiece shown in FIG. 6, taken along the line VII—VII.

The operation of the pins 18 is so timed in relation to the feeding of the workpiece 14 that whilst the portion X of the workpiece (FIG. 6) is passing underneath the row of pins 18, all the pins 18 are in their retracted condition. As the region Y passes underneath the row of pins 18, the combination of pins A to D (as shown in FIG. 5) are brought into their extended condition so as to apply pressure to the region 22 of the workpiece 14 that is to be skived. As the portion Z of the workpiece passes under the pins 18, the pins 18 are again retracted. The result of skiving the workpiece 14 is, as shown in FIG. 7, to produce a region 26 of reduced thickness.

The actuation of the pins 18 is controlled by computer control means comprising a computer CPU which has a memory for storing data relating to a range of workpiece shapes and pattern data relating to patterns of reduced thickness regions. In carrying out the first method in accordance with the invention the operator first identifies to the computer CPU e.g. through a keyboard (not shown), the particular workpiece shape and the selected pattern of reduced thickness regions. The computer CPU would then retrieve from its memory the corresponding data, in the form of a programmed instruction. Thereafter with the workpiece 14 placed on to the conveyer band 8 in a desired orientation (as expected by the computer CPU) the workpiece 14 is fed past the row of pins 18, and the pins 18 are operated in response to control signals generated by the computer programmed instruction and supplied to the actuators 16, so that successive combinations of pins 18 are located in their extended condition as the workpiece 14 passes therebeneath.

Figure 8:
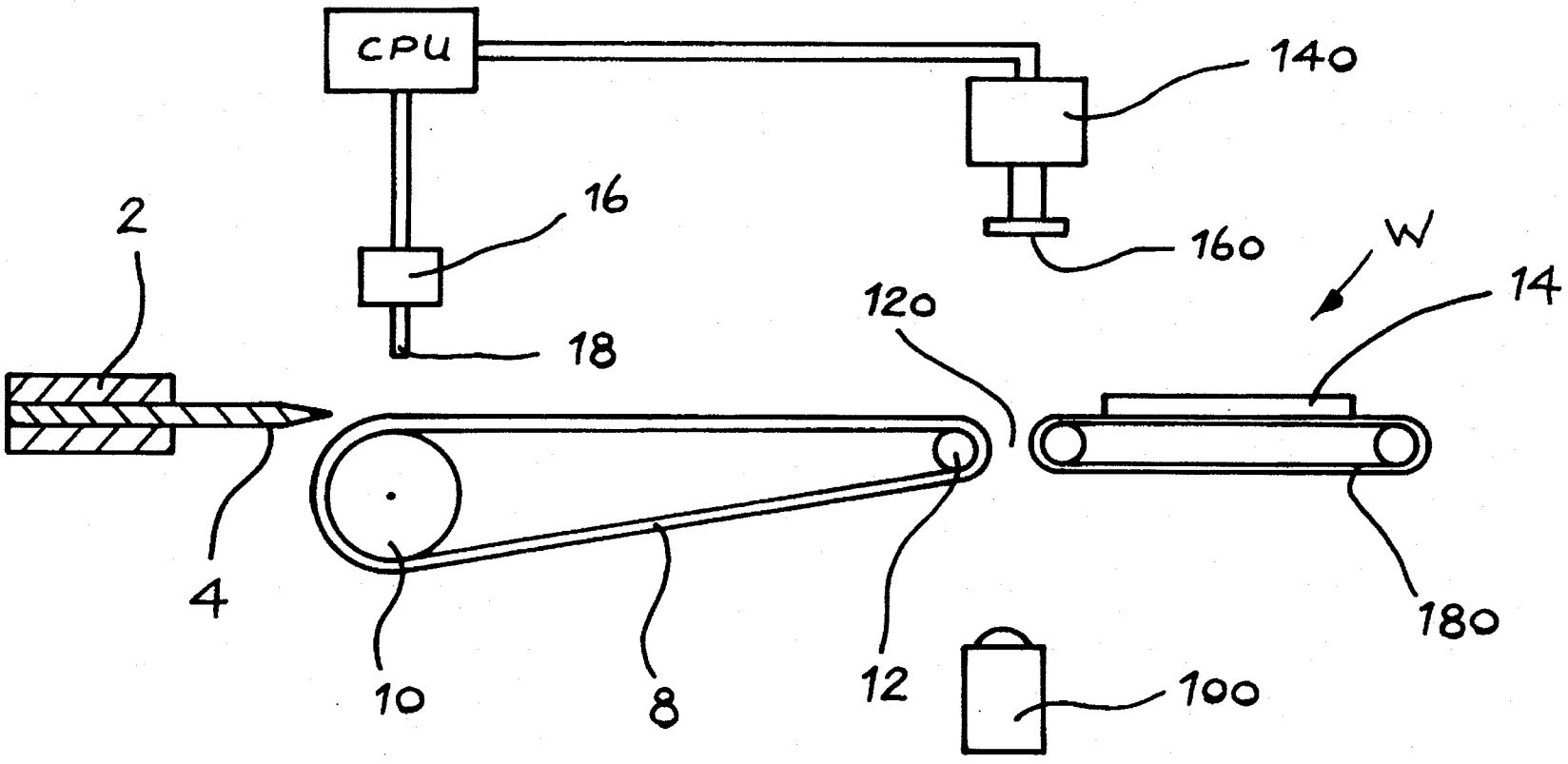
FIG. 8 is a side view of a second apparatus in accordance with the invention, comprising optical workpiece recognition means.

A second apparatus in accordance with the invention is illustrated schematically in FIG. 8, like parts to those shown in earlier Figures bearing the same reference numerals. Optical workpiece recognition means is located at a workpiece recognition station generally designated W. The optical workpiece recognition means, which is generally similar in construction and operation, except as hereinafter described, to the system described in EP-A-0 269 287, comprises, in addition to the conveyer band 8, a conveyer band 180 arranged with an upper reach thereof at the same height as the upper reach of the conveyer band 8 and spaced therefrom by a narrow gap 120 of a size which can be bridged by the workpiece 14. The conveyer bands 8, 180 operate at the same feed speed, to feed the workpiece 14 towards the pins 18. Aligned with the gap 120, beneath the conveyer bands 8, 180, is an array of filament lamps 100, while disposed in opposed relationship with the lamps 100, above the upper reaches of the conveyers, is a camera comprising an array of light detectors 140 arranged to receive light emitted by the lamps 100 and a high resolution lens 160 which focusses the light on to the detectors 140. It will be appreciated that the optical paths of the light from the lamps 100 will be interrupted upon the passage of the workpiece 14 across the gap 120, the advancing movement of the workpiece 14 being progressive, whereby the workpiece is "scanned" by the camera 140,160 as it is fed.

The computer CPU of this apparatus comprises processor means whereby firstly the signals from the camera are processed to provide workpiece data relating to certain parameters of the workpiece, together with workpiece positional and orientational data. In addition, as in the case of the first apparatus, the computer memory stores data relating to a plurality of workpiece shapes, but in this case such data is used by the processor means as comparison data for comparing the workpiece data therewith thus to identify the scanned workpiece and to determine its position and orientation. Moreover a pattern of reduced thickness regions can also be assigned, using the computer, to each workpiece for which comparison data is stored, by storing appropriate assignment data in the computer memory, the pattern data corresponding to the assigned pattern being then capable of recall when a workpiece is recognised as aforesaid.

In using the second apparatus, in carrying out a second method in accordance with the invention, a workpiece 14 placed by the operator, in random position and orientation, on the conveyer 180 is advanced thereby across the gap 120 on to the upper reach of the conveyer band 8, the camera 140,160 being effective to scan the workpiece 14 as it crosses the gap 120 and thereby identify it by comparing the workpiece data relating to the workpiece with the comparison data stored in the computer memory. In addition positional and orientational data for the particular workpiece is also generated and the assigned pattern data recalled. The processor means of the computer then modifies the pattern data in accordance with the workpiece positional and orientational data and, as the workpiece is then fed past the knife 4, a sequence of control signals, constituting operating instructions, is delivered to the actuators in accordance with the thus modified pattern data.

Figure 9:
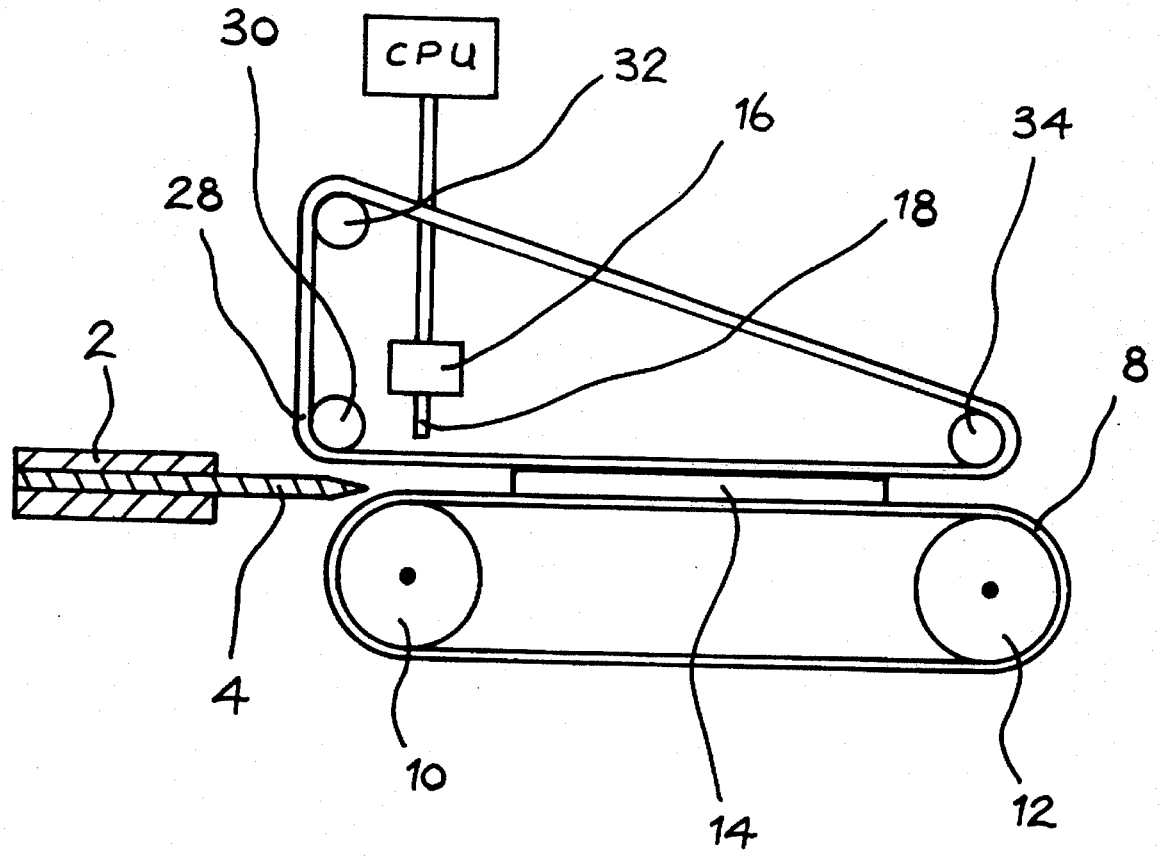
FIG. 9 is a side view of a third apparatus in accordance with the invention comprising workpiece feeding means in the form of two opposed bands.

A third apparatus in accordance with the invention is shown in FIG. 9. In this apparatus a belt 28 is provided which cooperates with the conveyer band 8 to reduce, if not eliminate, any tendency for the frictional effects of the pins 18 acting directly on to the surface of the workpiece 14 to drag the workpiece 14 out of position as it is being fed to the knife 6. More particularly, in this apparatus the belt 28 is interposed between the pins 18 and the workpiece 14, thus to apply pressure to the workpiece 14 through the belt, with the workpiece 14 thus being sandwiched between the conveyer band 8 and the belt 28. The belt 28 runs around three rollers 30, 32 and 34, one of which 32 is driven synchronously with the conveyer band 8.

In using the third apparatus, in carrying out a third method in accordance with the invention, the belt 28 bears down on the workpiece 14 to ensure that the position of the workpiece 14 relative to the moving surface of the conveyer band is held constant. The pins 18, when in their extended condition, apply a downwards force to the upper surface of a lower reach of the belt 28 and the force is then transmitted through the belt 28 to the workpiece 14, consequently deforming the workpiece 14 into the required position, as described earlier, in which to achieve a reduction in thickness. The upper surface of the conveyer band 8 has a "non-slip" coating which tends to hold the workpiece 14 in one place. The under-surface of the belt 28 similarly has a "non-slip" coating with a high coefficient of friction, whereas the opposite surface of the belt 28 has a much lower coefficient of friction so as to minimise frictional drag when the pins 18 are pressed into contact therewith.

It will of course be appreciated that the optical workpiece recognition means of the second apparatus could also be incorporated in this third apparatus.

We claim:

1. Apparatus for the treatment of a sheet material workpiece to reduce the thickness of a selected region thereof, comprising:

a band knife (4) having a blade portion (6) extending in a cutting plane (20);

workpiece feeding means (8,10,12) for supporting a workpiece (14) to be treated, said feed means being arranged to feed said workpiece past the band knife in a workpiece feed direction, said blade portion extending transversely of the workpiece feed direction;

a plurality of pressure-applying elements (18) extending in at least one row, immediately in advance of the knife and transversely of the workpiece feed direction, each element being independently movable between an extended condition, where it applies pressure to a section of a workpiece region to cause said section to be deformed in relation to the cutting plane and a retracted position where it does not apply such pressure;

actuator means (16) for effecting movement of each pressure-applying element (18) into and out of its extended condition; and, control means for controlling the operation of the actuator means whereby combinations of elements can be caused to be successively located in their extended condition in timed relation with the operation of the workpiece feeding means;

characterised in that the workpiece feeding means (8, 10, 12) comprises a workpiece support (8) configured to yield under pressure applied by the elements (18) to vary the relationship between said workpiece region supported thereby and the cutting plane, and thus the cutting blade portion (6), to be varied.

2. Apparatus according to claim 1 characterised in that the control means is constituted by computer control means operable in accordance with a programmed instruction containing pattern data relating to the succession of combinations of pressure-applying elements (18) to be located in their extended condition.

3. Apparatus according to claim 2 characterised in that optical workpiece recognition means (100,120,140,160) is provided by which a workpiece (14) to be treated is scanned and signals are generated and supplied to the computer control means according to certain parameters of the workpiece, and in that the computer control means comprises processor means for processing such signals to provide workpiece data relating to said certain parameters of the workpiece and also workpiece positional and orientational data, and a memory for storing comparison data relating to previously scanned workpieces, pattern data relating to selected regions of such workpieces the thickness of which regions is to be reduced, and assignment data associating comparison data for a particular workpiece with pattern data for a particular selected region, and in that when a workpiece (14) has been scanned by the workpiece recognition means the processor means compares the workpiece data with the comparison data and, upon finding a match, selects the associated pattern data, and then modifies the pattern data in accordance with the workpiece positional and orientational data, and in that the processor means supplies control signals to the actuator means (16) in accordance with the thus modified data.

4. Apparatus according to claim 1 characterised in that the workpiece feeding means (8,10,12) comprises a reach of a conveyor band (8) an upper, workpiece-supporting, surface of which lies in the cutting plane (20), but which is capable of yielding under pressure applied by the pressure-applying elements (18) and thus being urged out of said plane.

5. Apparatus according to claim 4 characterised by a further belt (28) which is advanced synchronously with the conveyer band (8) and between which and the conveyer band a workpiece (14) can be held and thus be fed progressively towards the knife, and characterised in that the pressure-applying elements (18) apply pressure to sections of the workpiece through said belt.

6. Method of treating a sheet material workpiece to reduce the thickness of a selected region thereof using a band knife, the method including the steps of:

(a) supporting a workpiece (14) on a support (8) to facilitate movement past a blade portion (6) of the band knife (6) on a workpiece movement direction;

(b) orienting said blade portion (6) in a cutting plane (20) which is traverse of the workpiece movement direction;

(c) deforming at least one region of said workpiece in relation to the cutting plane as it is moved past the blade portion (6) in the workpiece movement direction;

(d) removing a portion of said workpiece by said band knife;

(e) varying the deforming with regard to distinct regions of said workpiece as effected in step (c) and allowing the support provided by said support (8) in step (a) to yield to variable degrees in order to alter the relationship between said respective distinct regions and the cutting plane and thus the cutting blade (8).

7. Method as claimed in claim 6 wherein the steps (c) and (e) are performed upstream of the band knife so said workpiece is deformed in accordance with steps (c) and (e) across the cutting plane and so remove at least a portion of the workpiece as it is moved past the band knife.

8. Method as claimed in claim 6 wherein prior to performance of said method, a computer-control means is programmed with a sequential order for the operations defined in steps (c) and (e) and, said steps (c) and (e) are retrieved from said computer-control means in a sequential order to perform said method.

9. Method as claimed in claim 8 wherein prior to performance of the method, the workpiece is identified and its position and/or orientation determined and after said position and/or orientation determination, the sequential order and performance of steps (c) and (e) held in the computer-control means is modified.

* * * * *